US010098440B2

(12) United States Patent
Ly

(10) Patent No.: US 10,098,440 B2
(45) Date of Patent: Oct. 16, 2018

(54) LOAD-BEARING SYSTEMS

(71) Applicant: THE NORTH FACE APPAREL CORP., Wilmington, DE (US)

(72) Inventor: John Ly, Alameda, CA (US)

(73) Assignee: The North Face Apparel Corp., Wilmington, DE (US)

( * ) Notice: Subject to any disclaimer, the term of this patent is extended or adjusted under 35 U.S.C. 154(b) by 140 days.

(21) Appl. No.: 15/394,367

(22) Filed: Dec. 29, 2016

(65) Prior Publication Data

US 2017/0231369 A1 Aug. 17, 2017

Related U.S. Application Data

(60) Provisional application No. 62/273,868, filed on Dec. 31, 2015.

(51) Int. Cl.
*A45F 3/04* (2006.01)
*A45F 3/12* (2006.01)

(52) U.S. Cl.
CPC ..... *A45F 3/047* (2013.01); *A45F 3/12* (2013.01); *A45F 2003/045* (2013.01); *A45F 2003/127* (2013.01)

(58) Field of Classification Search
CPC ..... A45F 3/04; A45F 3/047; A45F 2003/045
USPC ..... 224/627–659, 262
See application file for complete search history.

(56) References Cited

U.S. PATENT DOCUMENTS 2,553,275 A * 5/1951 Quilter ..... B64D 17/32 224/637
5,114,059 A * 5/1992 Thatcher ..... A45F 3/04 224/148.5
5,449,102 A 9/1995 Sason
5,579,966 A * 12/1996 Krumweide ..... A45F 3/08 224/259
8,172,117 B2 * 5/2012 Maggi ..... A45F 3/047 224/263
9,901,162 B1 * 2/2018 Chang ..... A45F 3/047
2005/0017041 A1 1/2005 Roberts
2006/0102675 A1 * 5/2006 Bezak ..... A45F 3/047 224/628

(Continued)

FOREIGN PATENT DOCUMENTS

FR 2851437 A1 * 8/2004 ..... A45F 3/047
GB 2353389 A 1/2001

OTHER PUBLICATIONS

International Search Report and Written Opinion of the International Searching Authority dated Mar. 22, 2017 in International Application No. PCT/US2016/069285.

*Primary Examiner* — Justin Larson
(74) *Attorney, Agent, or Firm* — Ganz Pollard, LLC

(57) ABSTRACT

According to a first aspect, load-bearing systems can have one or more serpentine tensioners. According to another aspect, load-bearing systems can have one or more repositionable load-bearing members. Load-bearing systems having serpentine tensioners and load-bearing systems having repositionable load-bearing members are not mutually exclusive of each other. Accordingly, some disclosed load-bearing systems have a serpentine tensioner in combination with a repositionable load-bearing member. To facilitate disclosure of such principles, wearable packs incorporating one or more aspects of innovative load-bearing systems are described.

20 Claims, 9 Drawing Sheets

(56) References Cited

U.S. PATENT DOCUMENTS

| | | | | |
|---|---|---|---|---|
| 2006/0138188 | A1 | 6/2006 | Kramer | |
| 2008/0041906 | A1* | 2/2008 | Rose | A45C 13/30 224/628 |
| 2009/0057360 | A1* | 3/2009 | Demsky | A45F 3/047 224/262 |
| 2017/0231369 | A1* | 8/2017 | Ly | A45F 3/047 224/637 |
| 2018/0055198 | A1* | 3/2018 | Chang | A45F 3/047 |

* cited by examiner

LOAD-BEARING SYSTEMS

BACKGROUND

The innovations and related subject matter disclosed herein (collectively referred to as the "disclosure") generally pertain to load-bearing systems, and more particularly but not exclusively to adjustable load-bearing members, with a serpentine tensioner for a load-bearing strap, as for a mountable pack (e.g., a backpack, daypack, rucksack, knapsack, pannier, courier bag, brief case, motorcycle tank bag, etc.) being but one particular aspect of a disclosed load-bearing system and a continuously repositionable load-bearing strap or other member being but one other particular aspect of a disclosed load-bearing system.

Mountable (including but not limited to wearable) packs have long been known. Such packs typically have one or more compartments for storing a user's items and one or more load-bearing straps (e.g., a shoulder strap) or other load-bearing member (e.g., a hip-pad) configured to secure to, wrap around, urge against or otherwise mechanically engage a suitable structure to bear the load of a given mountable pack during use and/or storage. Typically, the compartments are secured or otherwise closed by closure systems such as zippers, drawing string systems, snap fasteners, hook and loop fasteners, resiliently extensible members, etc.

Many conventional load-bearing straps and other load-bearing members provide at least some measure of adjustment to provide a degree of customizable fit for each of a variety of applications. As one example, many conventional shoulder straps have an adjustable length, allowing tension in the strap to be adjusted according to load, or to adjust the fit of the shoulder strap for users of different girth. As another example, many conventional packs provide opposed load-bearing hip pads that cinch around a wearer's hips to allow a wearer's hips to support a portion of the pack's load that otherwise would be born by the wearer's shoulders. By adjusting the respective lengths of the shoulder straps and the hip-pads, a given pack's load can be distributed in a comfortable and selectable manner.

However, conventional load-bearing members expose unsightly excess lengths and/or numbers of straps. Moreover, most conventional load-bearing members only provide adjustment of one parameter (e.g., strap length). Thus, manufacturers of conventional packs often offer a given wearable pack in several different sizes, e.g., by varying a distance between an upper portion of the shoulder straps and the hip pads to accommodate users with different torso lengths.

As well, modern aesthetic preferences and consumer expectations weigh in favor of simple, uncluttered, and "clean" looking devices. Also, inventory managers prefer to reduce the number of variants (e.g., SKUs) of a given product.

Thus, a need exists for load-bearing systems arranged to provide reduced numbers and/or excess lengths of straps. A need also exists for a wearable pack configuration that can accommodate users of different girths and/or different torso lengths. A further need exists for components of fastener systems to have a built-in or integrated appearance, while retaining conventional and/or additional functions.

SUMMARY

The innovative load-bearing systems and related innovations disclosed herein overcome problems in the prior art and address one or more of the aforementioned, or other, needs.

According to a first aspect, load-bearing systems incorporating one or more serpentine tensioners are disclosed. According to another aspect, load-bearing systems incorporating one or more repositionable load-bearing members are disclosed. Load-bearing systems having serpentine tensioners and load-bearing systems having repositionable load-bearing members are not mutually exclusive of each other. Accordingly, some disclosed load-bearing systems incorporate a serpentine tensioner in combination with a repositionable load-bearing member. To facilitate disclosure of such principles, wearable packs incorporating one or more aspects of innovative load-bearing systems are described.

According to the first aspect, a load-bearing system for a wearable pack has a first floating block and a second floating block, as well as a first terminal anchor, a second terminal anchor, and an intermediate anchor providing three regions of engagement (e.g., anchoring) between the load-bearing system and a load carrier such as, for example, a major compartment of the wearable pack. Often, but not necessarily, such load-bearing systems can be symmetric about a vertical plane, providing a total of six regions of engagement symmetrically distributed over laterally opposed regions of the pack.

For example, each anchor can be positioned laterally outward relative to the first floating block and the second floating block. A serpentine tensioner can be fixedly coupled with the first terminal anchor and the second terminal anchor, and movably coupled with the first floating block, the second floating block, and the intermediate anchor. The serpentine tensioner can extend from the first terminal anchor to the first floating block, from the first floating block to the intermediate anchor, from the intermediate anchor to the second floating block, and from the first floating block to the second terminal anchor.

Some load-bearing systems also have a load-bearing member. At least a portion of the serpentine tensioner can be coextensive with a corresponding portion of the first load-bearing member.

In some embodiments, the load-bearing member can be fixedly coupled with the first terminal anchor. As well, a second load-bearing member can be fixedly coupled with the second terminal anchor.

The load-bearing member can be a first load-bearing member, and the load-bearing system further can have a second load-bearing member. At least another portion of the serpentine tensioner can be coextensive with a corresponding portion of the second load-bearing member.

The first load-bearing member can take the form of a shoulder strap. In some instances, the shoulder strap can be a first shoulder strap and the load-bearing system can have a second shoulder strap positioned laterally opposite the first shoulder strap relative to the first floating block.

In other embodiments, the first load-bearing member can take the form of a hip pad. In some instances, the hip pad can be a first hip pad and the load-bearing system can have a second hip pad positioned laterally opposite the first hip pad relative to the second floating block.

In some instances, the first load-bearing member can take the form of a shoulder strap and the second load-bearing member can take the form of a hip pad.

Some disclosed load-bearing systems are described in combination with a wearable mountable pack having a major compartment or other load carrier configured for carrying a load. In a general sense, some disclosed load-bearing systems have a load carrier, and the first terminal anchor fixedly couples the load-bearing member with the load carrier.

The serpentine tensioner can be affixed to the first terminal anchor. In other embodiments, the serpentine tensioner is spaced apart from the first terminal anchor and the corresponding load-bearing member couples the serpentine tensioner to the first terminal anchor. Some terminal anchors are at least partially formed from one or more of a reinforced region of fabric, a mesh, a metal, a wood, a composite, and a plastic.

The first terminal anchor can movably couple the load-bearing member with the load carrier. For example, the first terminal anchor can be a shuttle movably coupled to a track. The track can be affixed to the load carrier and the shuttle can be affixed to the load-bearing member. The shuttle can be so movably coupled with the track as to permit the shuttle to move along the track and to resist movement in a direction perpendicular to the track. As but one example, the shuttle can be slidably coupled with the track.

The load-bearing member, the shuttle, and the track can be so complementarily configured that the load-bearing member is movable along the track in correspondence with the shuttle in a manner suitable to reposition the load-bearing member relative to the load carrier to accommodate a plurality of user sizes and to transfer a load from the load carrier to the load-bearing member for each of the plurality of user sizes. In some embodiments, the serpentine tensioner is affixed to the shuttle.

As noted, some load-bearing systems include a load carrier. One or more of the first terminal anchor, the intermediate anchor and the second terminal anchor can be movably coupled with the load carrier. The load-bearing member can be fixedly coupled with a movable one or more of the first terminal anchor, the intermediate anchor and the second terminal anchor.

Some disclosed load-bearing systems have a respective movement limiter corresponding to one or more of the intermediate anchor, the first slidable block, and the second slidable block. Each respective movement limiter can be configured to limit an extent of slidable movement of the serpentine tensioner relative to the respective one or more of the intermediate anchor, the first slidable block, and the second slidable block.

According to a second aspect, load-bearing systems for a load-carrying apparatus can have a load carrier having a vertical axis generally aligned with a direction of gravity when the load-carrying apparatus is in use and a lateral axis extending generally transversely relative to the vertical axis. A load-bearing member can extend from a corresponding first terminal end to an opposed second terminal end. A movable anchor can be fixedly attached to the first terminal end of the load-bearing member and so movably coupled with the load carrier to permit the first terminal end of the load-bearing member to move continuously relative to the load carrier parallel to the lateral axis and to resist movement of the first terminal end of the load-bearing member relative to the load carrier in a direction parallel to the vertical axis.

As noted above, a track can be affixed to the load carrier. The movable anchor can be a shuttle movably coupled to the track. The shuttle can be so movably coupled with the track as to permit the shuttle to move along the track and to resist movement in a direction perpendicular to the track. In some embodiments, the shuttle is slidably coupled with the track. The load-bearing member, the shuttle, and the track can be so complementarily configured that the load-bearing member is movable along the track in correspondence with the shuttle in a manner suitable to reposition the load-bearing member relative to the load carrier to accommodate a plurality of sizes of structural supports and to transfer a load from the load carrier to the load-bearing member for each of the plurality of sizes of structural supports.

The second terminal end can be movably coupled with the load carrier. For example, the movable anchor can be a first movable anchor, and the load-bearing system further can have a second movable anchor movably coupling the second terminal end to the load carrier.

A first segment of track can correspond to the first movable anchor and a second segment of track corresponding to the second movable anchor. The first movable anchor can be a first shuttle movably coupled with the first segment of track and fixedly coupled with the first terminal end. The second movable anchor can be a second shuttle movably coupled with the second segment of track and fixedly coupled with the second terminal end.

Each respective segment of track can be affixed to the load carrier. The first shuttle and the second shuttle can be so movably coupled with the respective first segment of track and second segment of track as to permit the first shuttle and the second shuttle to move along the first segment of track and the second segment of track, respectively, and to resist movement in a direction perpendicular to the respective first segment of track and second segment of track.

In some instances, the first segment of track and the second segment of track are continuous with each other. For example, the first segment of track can be delineated by corresponding spaced apart first and second stops, and the first shuttle can be positioned between the first and second stops. Similarly, the second segment of track can be delineated by corresponding spaced apart first and second stops, and the second shuttle can be positioned between the first and second stops.

In other embodiments, the first segment of track and the second segment of track are discrete segments of track spaced apart from each other. Each of the first segment of track and the second segment of track can extends from a respective first terminal end of track to a respective second terminal end of track and have a respective first stop positioned at the corresponding first terminal end of track and a respective second stop positioned at the corresponding second terminal end of track.

As noted above, the load-bearing member can be a shoulder strap or a hip pad. In either case, the second terminal end of the load-bearing member can be fixedly coupled with the load carrier or removably coupleable with another load-bearing member.

Some load-bearing systems have two or more movable anchors associated with a given terminal end of a load-bearing member. For example, the movable anchor can be a first movable anchor, and the load-bearing system further can have a second movable anchor fixedly attached to the first terminal end of the load-bearing member. The first and the second anchors can be so movably coupled with the load carrier to permit the first terminal end of the load-bearing member to move continuously along the lateral axis relative to the load carrier and to resist movement of the first terminal end of the load-bearing member relative to the load carrier in a direction parallel to the vertical axis.

In some instances, the load-bearing member according to the second innovative aspect is a first load bearing member, and the load-bearing system further can have a second load-bearing member extending from a corresponding first terminal end coupled with the load carrier to a corresponding second terminal end. The first terminal end of the second load-bearing member can be movably coupled with the load carrier. The second terminal end of the second load-bearing member can be movably coupled with the load carrier or can be fixedly coupled with the load carrier. The second load-bearing member can be a shoulder strap or a hip pad.

As noted above, some load-bearing systems have a movable load-bearing member in combination with a serpentine tensioner. More particularly, but not exclusively, some disclosed systems have a load carrier having an upper region, a lower region, an intermediate region positioned between the upper region and the lower region, and laterally opposed lateral regions spanning the upper region, the intermediate region, and the lower region. A pair of laterally opposed shoulder straps can be spaced apart from each other. Each shoulder strap can have a first terminal end and an opposed second terminal end. Each first terminal end can be positioned adjacent the upper region of a corresponding one of the opposed lateral regions of the load carrier. A first terminal anchor can correspond to each of the first terminal ends of the shoulder straps, and each first terminal anchor can be movably coupled with the corresponding region of the load carrier such that each first terminal end is continuously movable relative to the load carrier. A first pair of detachably coupleable floating blocks can be positioned adjacent the intermediate region of the load carrier and laterally inward of the opposed shoulder straps. A pair of laterally opposed hip pads can be spaced apart from each other, and each can have a respective first terminal end coupled to the lower region of the load carrier and a respective second terminal end positioned opposite the corresponding first terminal end. An intermediate anchor can correspond to each of the first terminal ends of the hip pads and be coupled with the intermediate region of the load carrier at a position laterally outward of the first pair of floating blocks. A second pair of detachably coupleable floating blocks can be positioned adjacent the lower region of the load carrier and laterally inward of the intermediate anchors and the opposed hip pads. A second terminal anchor can correspond to each of the first terminal ends of the hip pads and be coupled with the lower region of the load carrier at a position laterally outward of the second pair of detachably coupleable floating blocks and opposite the upper region of the load carrier relative to the respective intermediate anchor. A pair of opposed serpentine tensioners can each be fixedly coupled with a respective one of the first terminal anchors and the corresponding second terminal anchor, and slidably coupled with each respective one of the corresponding first floating block, second floating block, and intermediate anchor. Each respective serpentine tensioner can extend from the corresponding first terminal anchor to the corresponding first floating block, from the corresponding first floating block to the corresponding intermediate anchor, from the corresponding intermediate anchor to the corresponding second floating block, and from the corresponding second floating block to the corresponding second terminal anchor.

A plurality of segments of track can be affixed to the load carrier. Each first terminal anchor can have a corresponding shuttle. Each respective shuttle can be so movably coupled with a corresponding segment of the track as to permit the shuttle to move along the respective segment of track and to resist movement in a direction perpendicular to the segment of track.

Each serpentine tensioner can have one or more movement limiters. Each respective movement limiter can be configured to limit an extent of slidable movement of the serpentine tensioner relative to a corresponding one of the intermediate anchor, the first slidable block, and the second slidable block. In some embodiments, the plurality of segments of track can be continuous with each other. In some instances, the intermediate anchors, the second terminal anchors, or both, are movably coupled with the load carrier.

These and other embodiments are described in more detail in the following detailed descriptions and the drawings. It is to be understood that other innovative aspects will become readily apparent to those skilled in the art from the following detailed description, wherein various embodiments are shown and described by way of illustration. As will be realized, other and different embodiments are possible and several details are capable of modification in various other respects, all without departing from the spirit and scope of the principles disclosed herein.

Accordingly the drawings and detailed description are to be regarded as illustrative in nature and not as restrictive. The appended claims, as originally filed in this document, or as subsequently amended, are hereby incorporated into this Summary section as if written directly in.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several aspects of the presently disclosed principles are illustrated by way of example, and not by way of limitation, in detail in the drawings, wherein.

DETAILED DESCRIPTION

By way of reference to specific examples, the following describes various innovative principles related to load-bearing systems, and more particularly but not exclusively to adjustable load-bearing members used in connection with bags or packs.

One or more of the disclosed principles can be incorporated in various system configurations to achieve any of a variety of corresponding system characteristics. The detailed description set forth below in connection with the appended drawings is intended as a description of various embodiments of disclosed principles and is not intended to represent the only embodiments contemplated by the inventor. Moreover, the detailed description includes specific details for the purpose of providing a comprehensive understanding of the principles disclosed herein. However, it will be apparent to those of ordinary skill in the art after reviewing this disclosure that one or more of the claimed inventions may be practiced without one or more of the illustrated details and/or in conjunction with details not expressly illustrated or described herein.

Stated differently, systems described in relation to particular configurations, applications, or uses, are merely examples of systems incorporating one or more of the innovative principles disclosed herein and are used to illustrate one or more innovative aspects of the disclosed principles. Thus, load-bearing systems having attributes that are different from those specific examples discussed herein can embody one or more of the innovative principles, and can be used in applications not described herein in detail. Accordingly, such alternative embodiments also fall within the scope of this disclosure, as will be appreciated by those of ordinary skill in the art following a review of this disclosure.

Overview

FIGS. 1 through 8 illustrate aspects of disclosed load-bearing systems having a serpentine tensioner for adjusting fit of a mountable pack to correspond to a plurality of structural supports of different sizes (e.g., wearers, users, frames, chassis, foundations, etc.). In the illustrated embodiments, an opposed pair of continuous bands or straps (sometimes referred to herein as "serpentine tensioners") extend among six symmetrically arranged points-of-attachment to the pack (i.e., three for each continuous band). Other embodiments have opposed pairs of serpentine tensioners extending among eight symmetrically arranged regions-of-attachment to a given pack. In any event, each band extends through several blocks to permit the respective band to change direction in a serpentine fashion as it extends among the several regions-of-attachment.

Figures 1, 2:
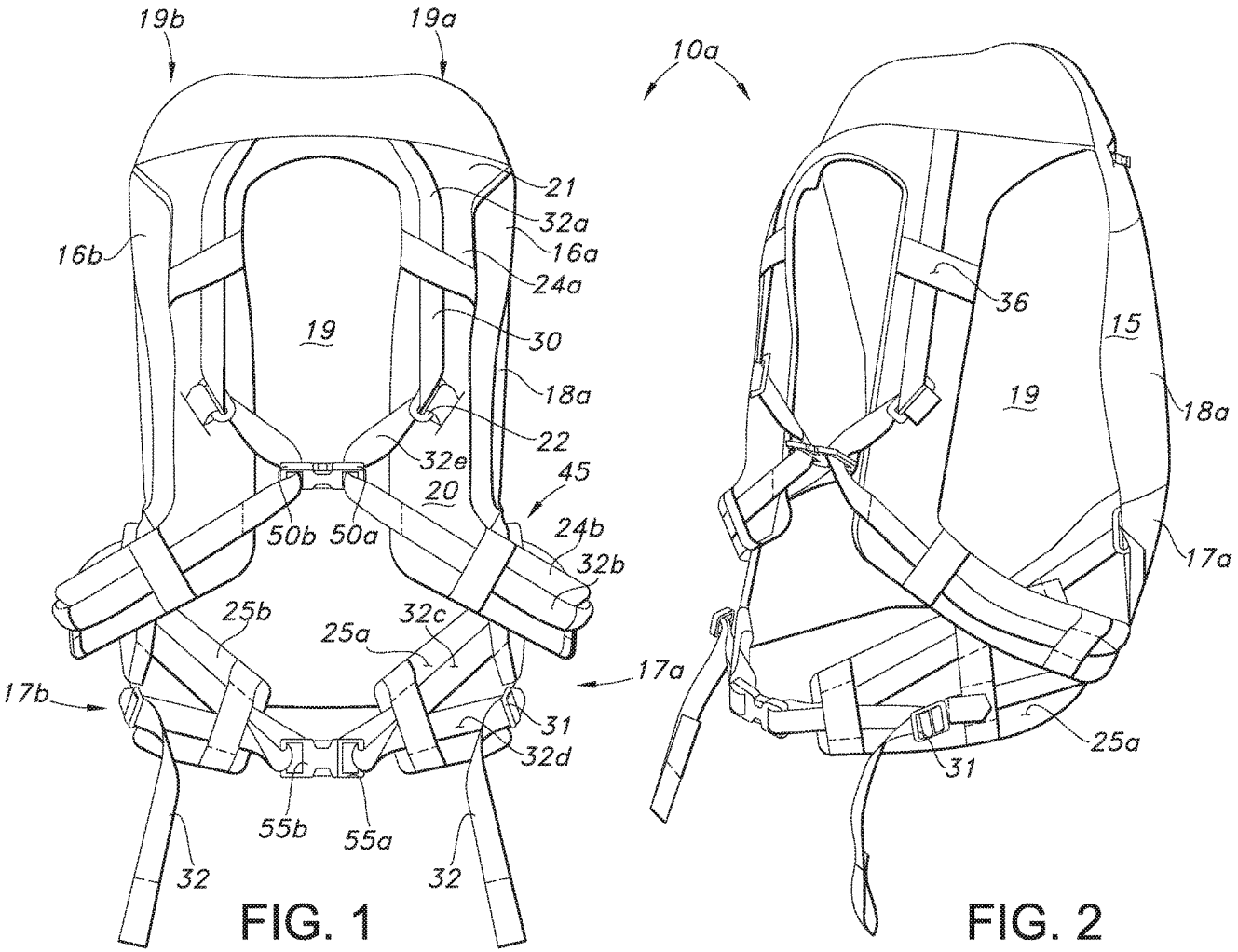
FIG. 1 shows a wearable pack having a pair of opposed serpentine tensioners representing but one particular example of a disclosed load-bearing system.
FIG. 2 shows an isometric view from in front of the wearable pack shown in FIG. 1.
Figures 3, 4:
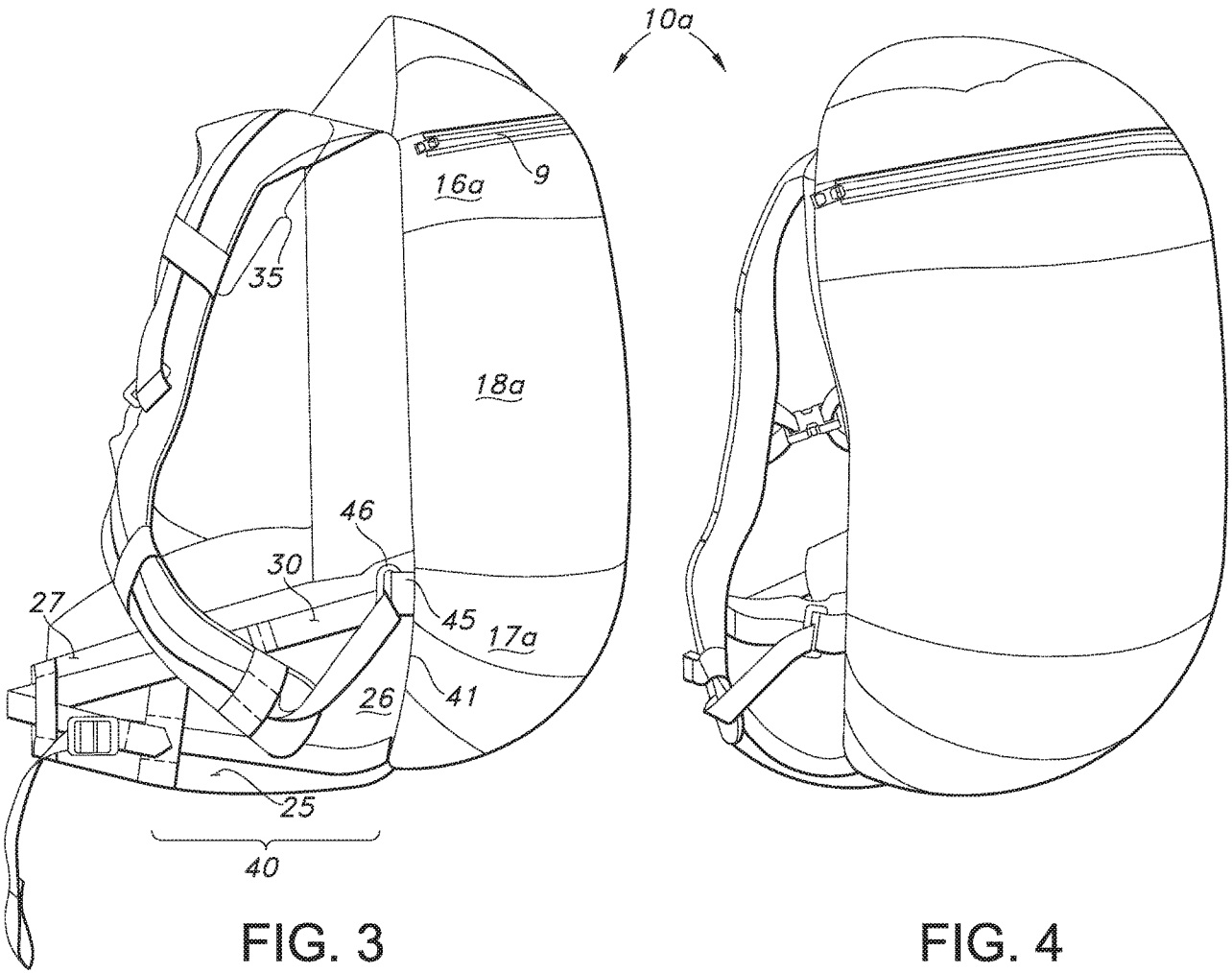
FIG. 3 shows a side elevation view of the wearable pack shown in FIG. 1.
FIG. 4 shows an isometric view from behind the wearable pack shown in FIG. 1.
Figure 5:
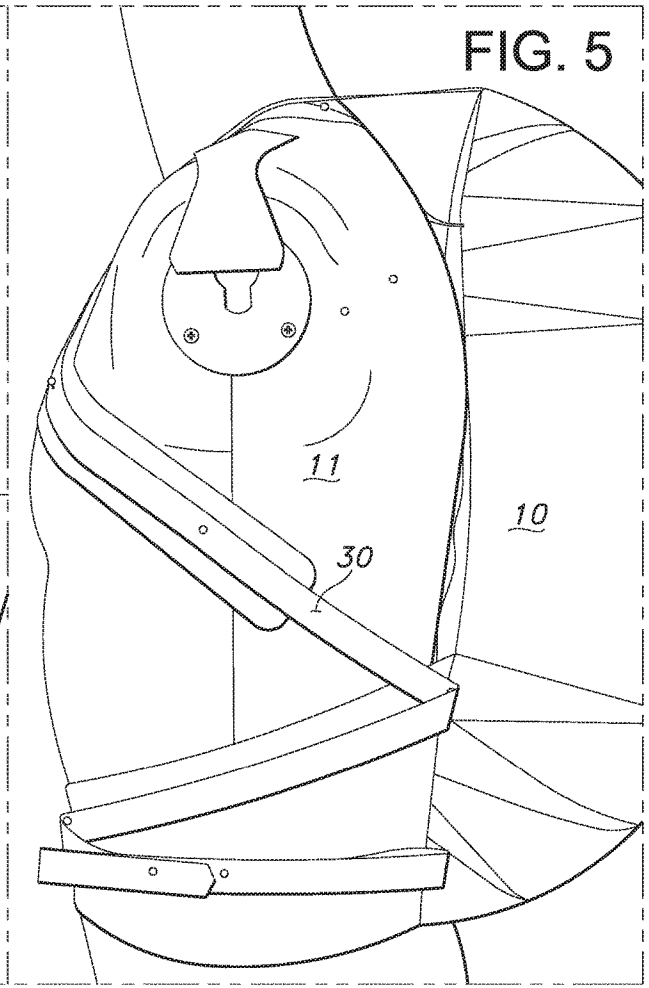
FIG. 5 shows a side elevation view of the path defined by the serpentine tensioner shown in FIG. 1 when the wearable pack shown in FIG. 1 is donned.
Figure 6:
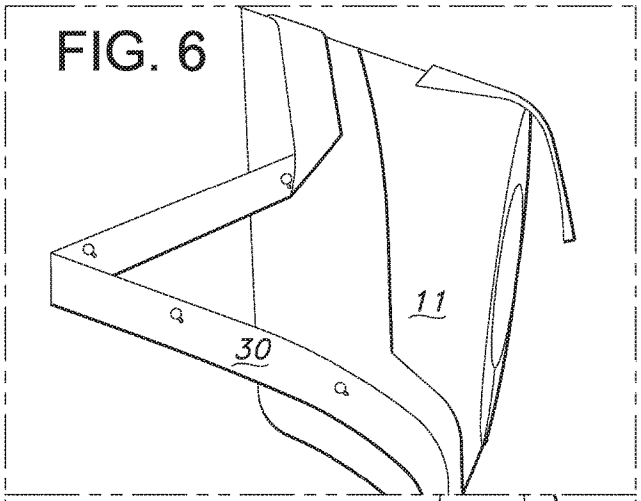
FIG. 6 shows a front elevation view of an upper portion of the path defined by the serpentine tensioner shown in FIG. 1 when the wearable pack shown in FIG. 1 is donned.
Figure 7:
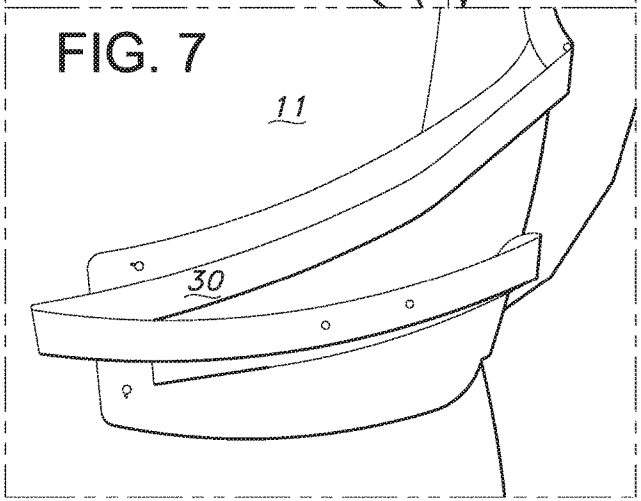
FIG. 7 shows a side elevation view of a lower portion of the path defined by the serpentine tensioner shown in FIG. 1 when the wearable pack shown in FIG. 1 is donned.

In FIG. 1, a load-bearing system for the illustrated wearable pack 10*a* has a load carrier 15 and a pair of laterally opposed shoulder straps 20 extending from laterally opposed upper regions 16*a*, 16*b* of the load carrier. A pair of laterally opposed hip pads 25*a*, 25*b* extends from laterally opposed lower regions 17*a*, 17*b* of the load carrier. A first serpentine tensioner 30 corresponds to one of the shoulder straps 20 and one of the hip pads 25. A second serpentine tensioner 30 corresponds to the other of the shoulder straps 20 and the other of the hip pads 25.

A first terminal anchor 35 is positioned adjacent the first terminal end 21 of each shoulder strap 20 and secures the corresponding serpentine tensioner 30 to the respective shoulder strap 20. A second terminal anchor 40 is positioned adjacent a region of attachment 41 between each hip pad 25 and the respective lower region of the pack 17*a*, 17*b*. In the embodiment shown in FIG. 1, the second terminal anchors 40 secure each respective serpentine tensioner 30 to the respective hip pad 25. In other embodiments, the anchor secures the hip pad to the pack. A pair of laterally opposed, intermediate anchors 45 is secured to the pack 10*a* adjacent the intermediate regions 18*a*, 18*b* and/or the lower regions 17*a*, 17*b* of the pack.

Each serpentine tensioner 30 extends from the respective first terminal anchor 35 and through a corresponding first floating block 50*a*, 50*b* positioned laterally inward of the shoulder straps 20. In the embodiment shown in FIG. 1, an intermediate block 22 is affixed to each shoulder strap 20 at an intermediate position between the corresponding first terminal anchor 35 and the corresponding first floating block 50*a*, 50*b*. Although the intermediate blocks 22 are not necessary, the intermediate blocks change a direction of, or bend, the serpentine tensioner 30 in a robust and reliable arrangement that reduces a likelihood of delaminating the tensioner 30 from the shoulder strap 20 at the first anchor 35. For example, the intermediate blocks 22 maintain a primarily shear load between the tensioner 30 and the corresponding shoulder strap 20 in the anchor region 35 and reduce or eliminate a peeling load that otherwise could be applied to the interface between the tensioner and the shoulder strap if the intermediate blocks were not included.

The opposed first floating blocks 50*a*, 50*b* can be so complementarily configured relative to each other as to be removably coupleable (e.g., matingly engageable) with each other. In FIG. 1, the first floating blocks 50*a*, 50*b* are matingly engaged with each other and can be selectively disengaged from each other to facilitate donning and doffing, or otherwise mounting and dismounting. As each serpentine tensioner 30 passes through the respective first floating block 50*a*, 50*b*, the tensioner 30 bends or otherwise changes direction to extend laterally outward toward the corresponding intermediate anchor 45.

Each of the intermediate anchors 45 slidingly couples the serpentine tensioner 30 to the load carrier 15 and includes a corresponding block 46 to turn the respective serpentine tensioner 30 laterally inward toward respective second floating blocks 55*a*, 55*b*. As with the first floating blocks 50*a*, 50*b*, the second floating blocks 55*a*, 55*b* can be so complementarily configured relative to each other as to be removably coupleable with each other. In FIG. 1, the second floating blocks 55*a*, 55*b* are matingly engaged with each other and can be selectively disengaged from each other to facilitate donning and doffing, or otherwise mounting and dismounting. As each serpentine tensioner 30 passes through the respective second floating block 55*a*, 55*b*, the tensioner bends or otherwise changes direction to extend laterally outward toward the corresponding second terminal anchor 40.

In the illustrated embodiment of each serpentine tensioner has a buckle 31, or "tension lock," positioned between the respective second floating block 55*a*, 55*b* and the respective second terminal anchor 40. Each tension lock 31 allows a user to adjust a length of the corresponding serpentine tensioner 30 by pulling on a respective excess length 32 of strap to draw a portion of each tensioner 30 through the respective buckle. Such a length adjustment adjusts tension in the respective serpentine tensioner when the mountable pack is mounted to a given structural support 11 (e.g., a wearer's torso). Such length and tension adjustment permits the fit of the wearable pack 10*a* to be adjusted to accommodate wearers of different sizes (e.g., girths) with a single adjustment. Although the buckle 31 is positioned adjacent a lower region of the serpentine tensioner in the illustrated embodiment, the buckle can be positioned anywhere along the serpentine tensioner, including by way of example, adjacent the first terminal anchor 35 or another upper portion of the tensioner 30.

In contrast, conventional load-bearing systems incorporating shoulder straps and hip pads require adjustment of two or more different straps on each opposed side of a medial plane and have correspondingly increased numbers of excess strap lengths 32, making conventional load-bearing systems less aesthetically appealing and more cumbersome to use compared to presently disclosed load-bearing systems.

FIGS. 9 through 13 illustrate aspects of disclosed load-bearing systems having one or more load-bearing members 20 (e.g., shoulder straps, etc.) that are continuously repositionable relative to the load carrier 15 of the wearable pack 10*b*. The continuously repositionable load-bearing members 20 are illustrated independently of the embodiment 10*a* having serpentine tensioners 30 to facilitate a clear and concise description of relevant principles. Nonetheless, as described more fully below, some wearable packs and other load carriers include one or more serpentine tensioners 30 in combination with continuously repositionable load-bearing members 20 as shown in FIGS. 9 through 13; such embodiments are not mutually exclusive of each other.

Figure 9:
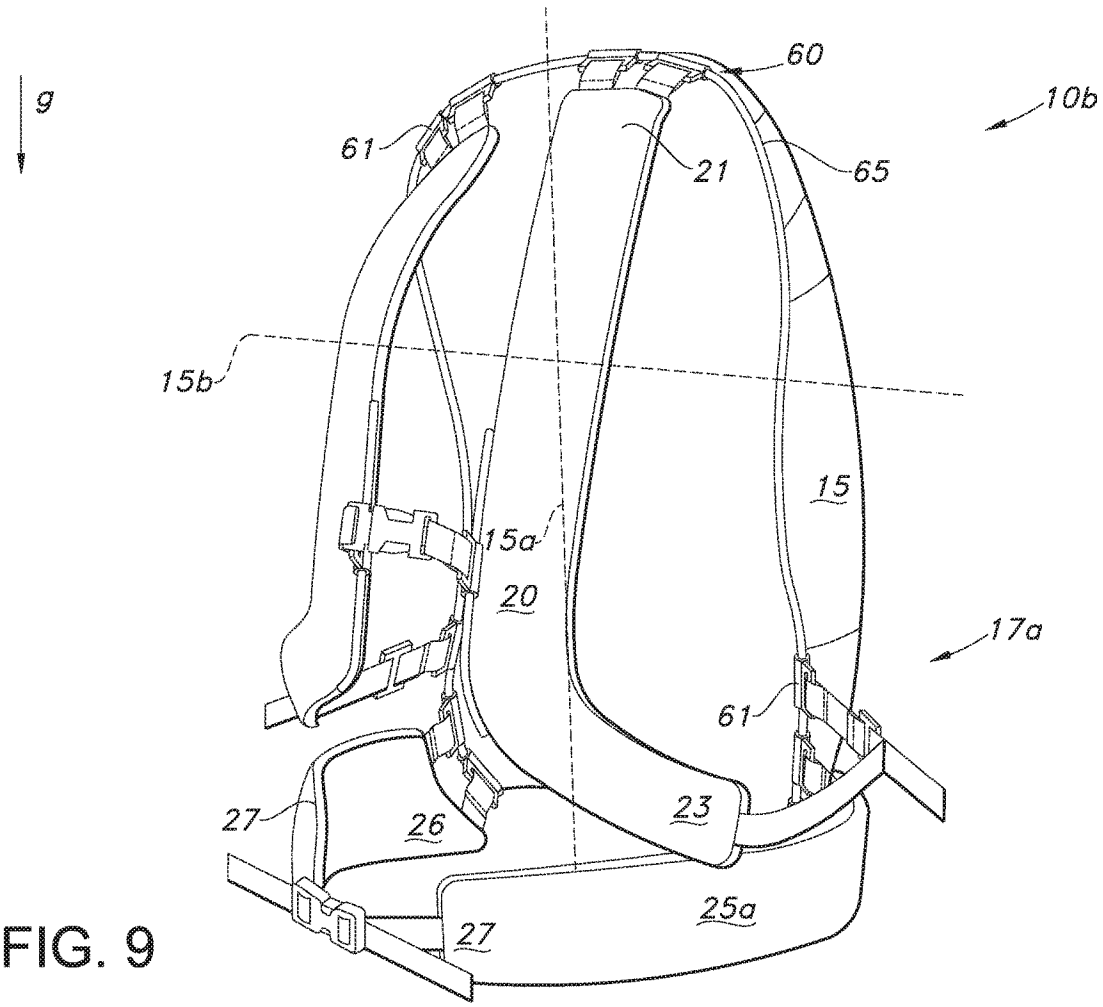
FIG. 9 shows an isometric view from in front of a wearable pack having a plurality of movable anchors representing but one particular example of a disclosed load-bearing system.
Figure 10:
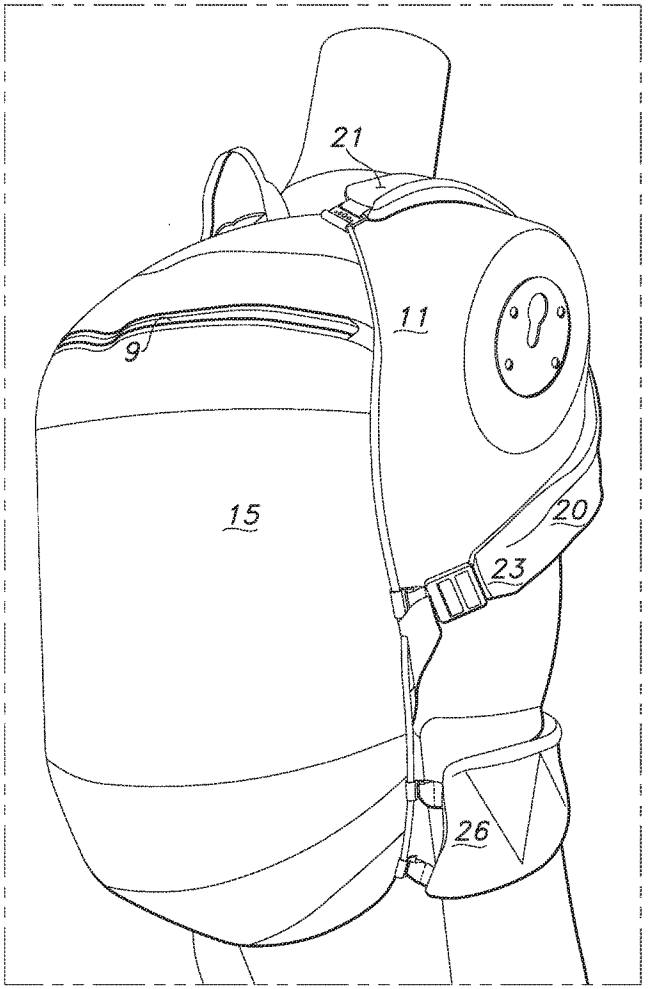
FIG. 10 shows an isometric view from behind a wearable pack depicted in FIG. 9 mounted on a mannequin.
Figure 11:
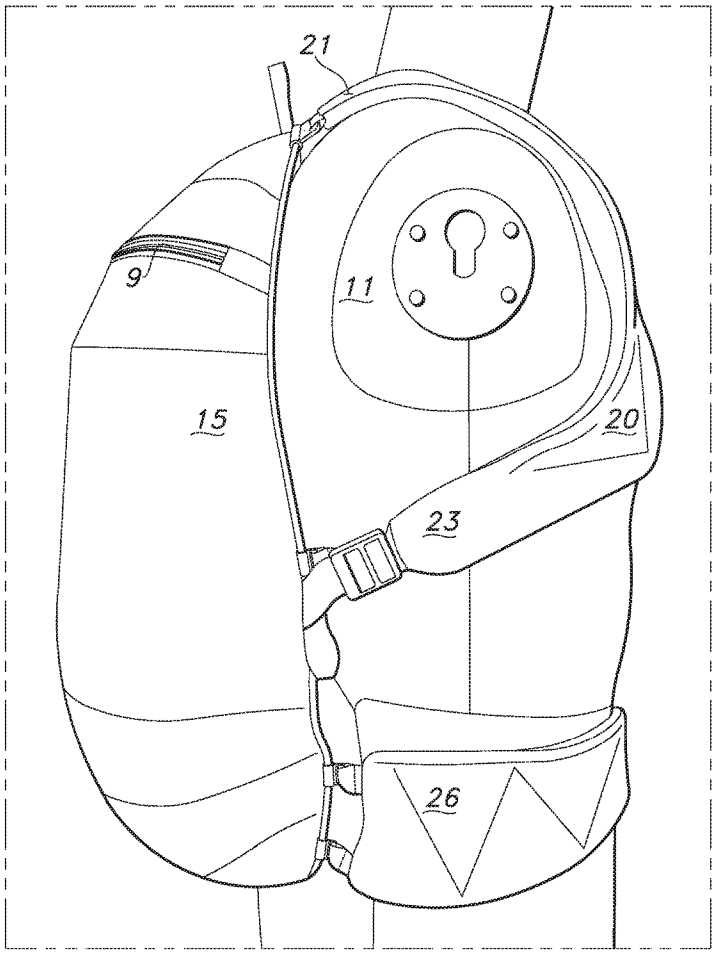
FIG. 11 shows a side elevation view of the mounted, wearable pack depicted in FIG. 10.

In FIG. 9, a load-bearing system for the illustrated wearable pack 10*b* has a load carrier 15 with a vertical axis 15*a* generally aligned with a direction of gravity, g, when the load-carrying apparatus is in use and a lateral axis 15*b* extending generally transversely relative to the vertical axis. A pair of laterally opposed shoulder straps 20 extend from respective first terminal ends 21 to respective opposed second terminal ends 23. A pair of laterally opposed hip pads 25*a*, 25*b* extend from laterally opposed lower regions 17*a*, 17*b* of the load carrier.

A movable anchor 60 is fixedly attached to each respective first terminal end 21 of the shoulder straps 20. The movable anchors 60 are so movably coupled with the load carrier 15 to permit the first terminal end 21 of each shoulder strap 20 to move continuously relative to the load carrier 15 in a direction generally parallel to the lateral axis 15*b* and to resist movement of the first terminal end 21 of the load-bearing member 20 relative to the load carrier 15 in a direction generally parallel to the vertical axis 15*a*.

Figure 12:
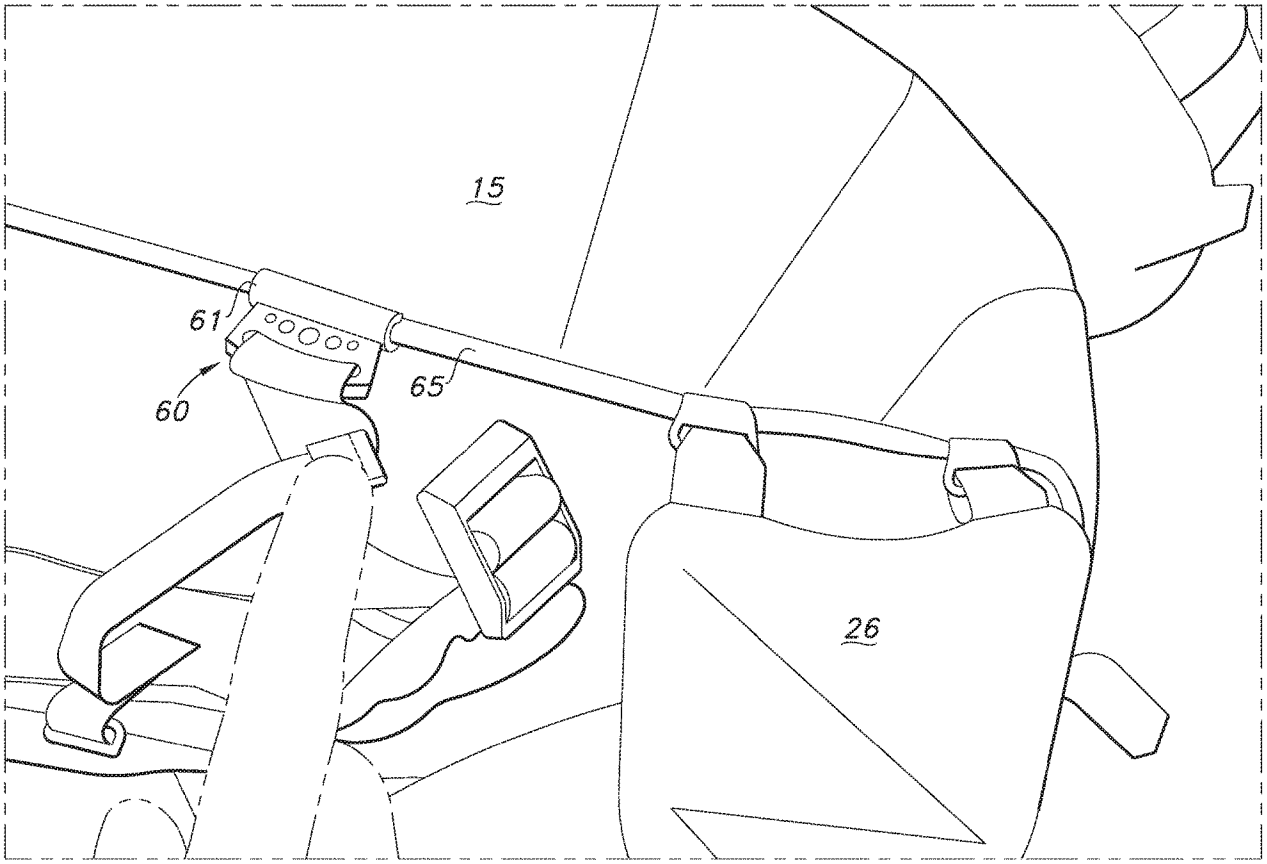
FIG. 12 shows detail of but one example of a movable anchor of the type described herein.
Figure 13:
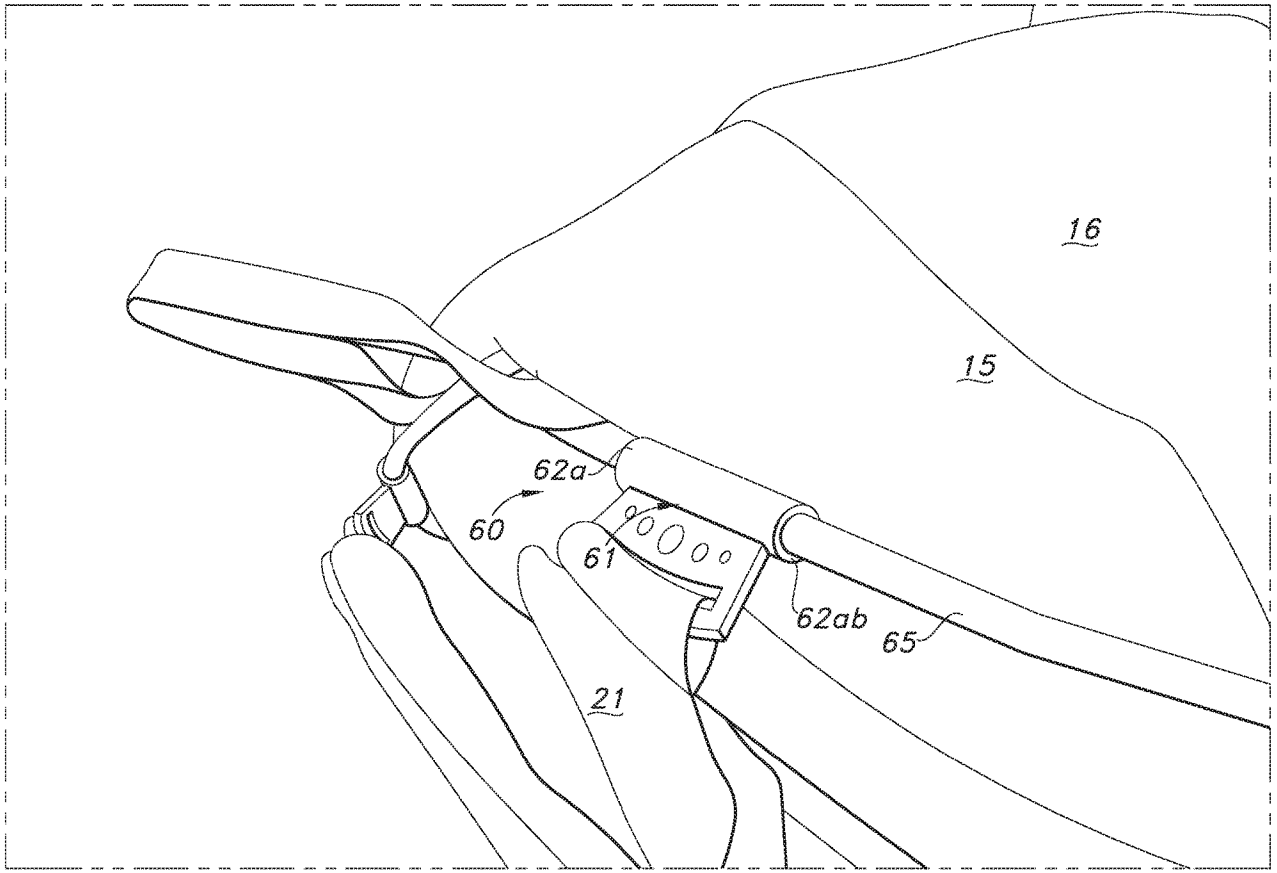
FIG. 13 shows additional detail of a movable anchor as depicted in FIG. 12.

As shown in FIG. 9, and in more detail in FIGS. 12 and 13, a track 65 can be affixed to the load carrier 15. Each movable anchor 60 can have a corresponding shuttle 61 so movably coupled to the track 65 as to permit the shuttle 61 to move along the track and to resist movement in a direction perpendicular to the track.

Referring again to the embodiment depicted in FIG. 9, the opposed, second terminal end 23 of each shoulder strap 20 is also movably coupled to the load carrier in a similar manner as the first terminal ends 21. In other embodiments, the second terminal ends 23 are immovably affixed to the load carrier 15.

As well, the illustrated hip pads 25 in FIG. 9 also are movably coupled with the load-carrier 15 at respective first terminal ends 26. As shown, a plurality of anchors 60 can movably couple the first terminal end 26 of each hip pad 25 to the load carrier 15.

Such movable couplings can permit the first terminal end 21, 26 of the respective load-bearing member (e.g., shoulder strap 20 or hip pad 25) to move continuously parallel to the lateral axis 15*b* relative to the load carrier 15 and to resist movement of the first terminal end of the respective load-bearing member relative to the load carrier in a direction parallel to the vertical axis 15*a*.

By permitting a degree of continuous movement of the shoulder straps 20 and/or hip pads 25 relative to the load carrier 15, the fit of a given wearable pack 10*a*, 10*b* can adjust to accommodate a wide range of sizes of users and/or other structural supports 11. In contrast, for example, a conventional wearable pack with fixed shoulder straps and/or hip pads affixed to a load carrier 15 at one or both ends cannot facilitate wearers with substantially different torso lengths or widths (girths). Accordingly, conventional wearable packs are provided in different sizes to accommodate such different sizes of wearers, increasing the number of different products and thus the planning, purchasing and inventory management overhead imposed on manufacturers, distributors, and retailers. By providing a "one-size-fits-all" or a "one-size-fits-many" pack 10*a*, 10*b* of the types disclosed herein, overhead associated with planning, purchasing and managing inventory can be reduced, and overall user comfort and performance can be improved.

Wearable Packs

FIGS. 1 and 9 illustrate possible embodiments of a load carrying apparatus taking the form of a wearable pack 10*a*, 10*b* which in this case is a backpack. The body 15 of each pack 10*a*, 10*b* has an overall construction defining an enclosed one or more volumes, or compartments, for containing one or more articles. The enclosed one or more compartments can be defined by an assembly of sheet- or panel-like members, sometimes referred to in the art as "surfaces," each having a major surface facing outward relative to the enclosed volume and an opposed major surface facing inward relative to the enclosed volume when the panels are assembled into the body of the pack. The surfaces need not come together in discrete joints; they may merge in curving interfaces, for example, and/or otherwise constitute a continuous (e.g., unitary) construct. Typically, the surfaces are made of a pliable material, such as one or more layers of a knit or a woven or non-woven textile, but the pack may be made in whole or part of shape-holding, semi-rigid or rigid materials, such as plastics, polymer foams, metals, and/or composites.

In at least the case of backpacks, the body 15 is generally sized and shaped so that it fits comfortably against the back of a wearer. In some cases, a portion (e.g., back surface 19) may be contoured to conform to the contours of anatomy of a wearer's back. The body 15 can, but need not, be dimensioned so as not to exceed about the width of the wearer's back.

Backpacks may be sized and shaped differently to accommodate variations in height, e.g., small, medium, or large. Or they may be sized and shaped to fit gender or age categories, e.g., men, women, or children. However, as disclosed herein, some backpacks are intended to provide a "one-size-fits-all" or a "one-size-fits-many" configuration, eliminating or reducing the need to provide a large number of sizes of packs to accommodate variations in height or girth of intended users.

Typically, the body of a pack includes a closeable opening 9 to provide a user with access to a compartment in the pack. In the depicted embodiments, the opening 9 provides access within the upper region 16 of the pack to a main compartment. The opening 9 may extend down one or both sides of the pack to a desired degree. The opening 9 may be secured in the closed condition by a closure system, such as a mechanism based on interlocking male/female parts, e.g., snaps; a zipper; hook and loop fasteners; buttons, etc., or another coupler.

The opening 9 can be created by the separation of a portion of the pack from another portion. A front portion of the pack can be movable relative to a back portion 19.

The pack may have static frame elements that help support the pack in a desired configuration, such as a frame element, which helps keep the front portion and back portions of the pack separated, maintaining the structure and volume of the main compartment. As shown in the drawings, the static frame element may be semi-rigid to allow some resilient flexibility to the back while still generally holding a compartment in a desired shape.

In addition to the main compartment, the body 15 may include any number of other compartments for containment of articles. Other compartments may be arranged adjacent, side-to-side or up and down relative to the main compartment or to each other. The body, including any of its compartments, may also have pockets arranged on the inside or outside of the compartments. For example, a pocket (not shown) may also be arranged on the front of body. As used herein, the term "compartments" refers to relatively large areas for holding things such as, sleeping bags, laptops, articles of clothing, books, etc. Generally, the term "pockets" refers to relatively smaller areas for holding things, such as wallets, mobile phones, media players, water bottles, etc. However, there is not always a clear dividing line between an enclosure considered as being a compartment and an enclosure considered as being a pocket, e.g., beyond the main compartment of a pack. Some packs 10*a*, 10*b* have an optional backside-accessible compartment (not shown), separated from the main compartment, for storing an object such as a laptop computer. When present, such a compartment can often be accessed by, for example a zipper closure system.

In addition to the shoulder straps 20 for carrying the body 15 of the pack on the body of a wearer or other support structure 11, the pack 10*a*, 10*b* may also optionally include a handle or grip (not shown). Examples of adjustable load-bearing members are described more fully below.

The body 15 of a pack may be constructed of one or more plies of thin, pliable material. Typical pliable materials for use in the body include, natural and synthetic materials, Nylon fabrics, polyester fabrics, natural or synthetic rubber or rubber-like plies of material, animal hides (e.g., leather), cotton, canvas, hemp, wool, and fabric blends. These materials can be used singly or in combination with each other. The body 15 may be formed using materials having continuous surfaces such as Nylon plain weave or twill fabric or perforated surfaces such as net or web structures.

Frame elements may be associated with the pliable materials or other body forming materials by incorporating them between layers or by affixing them on exterior or interior surfaces of the materials. Further, a panel or portion of the pack may be monolithically molded or otherwise formed of a rigid material to provide a rigid or semi-rigid structure.

Load-Bearing Members

The load-bearing members 20, 25 (FIGS. 1 and 9) coupled to the wearable pack may be discrete items connected to the body 15 or structures integrated with the body that are, for example, woven, knitted or molded in a unitary form with the body portion of the pack. In the embodiments shown in the accompanying drawings, the load-bearing members 20, 25 are configured as body strapping members configured as a pair of shoulder straps 20 and hip pads 25. In other embodiments, a relatively longer, single strap can be configured to fit over one shoulder of and across a wearer's chest and under the arm opposite the shoulder, as is known in the case of bike messenger bags, for example.

As used herein, the term "strap" is meant to refer to not only pliable, webbing and band-like structures but also individual filaments or bundles of filaments, chains, cords, cables, etc. that provide the functionality for the purposes described herein. A strap may have an elastic or inelastic construction. It may also have a construction of elastic and inelastic sections. The backpacks shown in the drawings include one or more shoulder straps 20 and/or one or more hip pads 25.

The shoulder straps 20 and/or hip pads 25 can be based on single-ply straps of material or they can be a composite of materials, as is known in higher-end backpacks for carrying heavier loads. Often, the portion of the shoulder strap or hip pad that bears against a wearer's body is made using a padded or cushioning material or construction. For example, it may be a composite of a cellular foam material, such as polyurethane, molded or cut EVA foam (ethylene-vinyl acetate), padded mesh—often referred to in the art as nylon or polyester spacer mesh—surrounded by or joined to a fabric such as nylon.

Referring now to FIG. 9, as a particular example, the straps 20 of some wearable packs are adjustable in length. Such adjustability can allow different-sized wearers to use a given pack, and can allow a given user to adjust a fit of the pack to accommodate loads of different sizes and weights.

An adjustable-length strap 20 can have a shoulder-engaging portion extending from the first terminal end 21 to the second terminal end 23. Extending from the second terminal end, a strap can extend through a tension lock and another strap can be fixedly or movably anchored to a suitable region on the pack selected to provide suitable user comfort and/or load carrying performance.

Serpentine Tensioners

As used herein, the term "tension member" refers to any structure suitable to convey a load from one region to another region when the structure placed in tension. As briefly described above, a serpentine tensioner (or tension member) can provide a single means of adjustment for a given set of load-bearing members, e.g., shoulder straps 20 or hip pads 25. Throughout this disclosure and in the claims, use of the term "strap" shall be interpreted in a more general sense of a flexible tensile member. More particularly, but not exclusively, examples of flexible tensile members include rope, bands, strings, filaments, fabric, rods, wires, twine, woven, knit or braided straps, metal cables, plastic bands, hoses, and elastic bands.

As shown in FIG. 1, at least a portion 32*a*, 32*b*, 32*c*, 32*d* of the serpentine tensioner 20 can be coextensive with a corresponding portion 24*a*, 24*b*, 27*a*, 27*b* of a corresponding shoulder strap or hip pad. The shoulder strap 20 and/or hip pad 25 can be based on single-ply straps of material or they can be a composite of materials, as is known in higher-end backpacks for carrying heavier loads.

Blocks

As used herein, the term "block" refers to a structure configured to bend or otherwise rearrange a flexible or a pliable tension member to facilitate a change in direction of force applied by the tension member. For example, referring to FIG. 1, the serpentine tensioner 30 passes through the intermediate block 22, changes direction from a substantially vertically arranged segment 32*a* extending between the first terminal anchor 35 and the intermediate block 22 to a transversely arranged segment 32*e* extending between the intermediate block 22 and the first floating block 50*a*, 50*b*. With such a change in direction, the serpentine tensioner 30 applies a generally transverse load to the first floating block 50*a*, 50*b* and a generally vertical load to the first terminal anchor 35.

Examples of blocks include eyelets, apertures, slots, grooves, channels, pulleys, or other suitable members against which a tension member can urge and thereby bend. In some embodiments, a block can provide a movable coupling with the corresponding tension member to permit the tension member to move relative to the block. A representative example of such a movable coupling includes a slidable coupling in which the tension member 30 can slip (or "slide") relative to a given surface of the block, e.g., floating block 50*a*. Another example of a movable coupling includes a roller coupling (e.g., a pulley) in which the tension member can move relative to the block but the surface of the tension member remains stationary (e.g., does not slip) relative to a surface of the block in contact with the tension member. In some embodiments, a block can provide aspects of both a roller coupling and a slidable coupling. For example, a tension member can move relative to a block at a given rate, and a surface of the tension member can slip relative to a surface (e.g., a groove in a pulley) at a lower rate, as with a pulley that does not rotate freely under a tension load applied to the tension member.

As described herein, some blocks are fixedly attached to another member and some blocks are movable, or allowed to "float", relative to another member. For example, a movable block can self-adjust its position to reach a stationary position of equilibrium in which loads and moments applied to the block are balanced, or in equilibrium, with each other. The intermediate block 22 illustrated in FIG. 1 is a stationary block, as it is affixed to a corresponding shoulder strap 20. The floating block 50*a* illustrated in FIG. 1 is a movable block, as it is movable and self-adjustable relative to the serpentine tensioner 30 and the opposed floating block 50*b* to which it is matingly engageable. Such a movable block 50*a* can move along the serpentine tensioner until the block 50*a* reaches a position and an orientation in which all forces and moments applied to the block are balanced, or in equilibrium.

In some embodiments, limiting an extent of movement of the serpentine tensioner 30 relative to one or more blocks can be desirable. Accordingly, some serpentine tensioners 30 have a respective movement limiter 33 corresponding to one or more blocks as shown by way of example in FIG. 8.

In a general sense, a movement limiter 33 has first and second opposed stops 33*a*, 33*b* positioned on opposed sides of a given block 46. As the serpentine tensioner 30 moves relative to that block 46, one of the stops (e.g., stop 33*a*) moves toward the block and the other stop (e.g., stop 33*b*) moves away from the block. Once the serpentine tensioner 30 moves a maximum extent allowed by the stops 33*a*, 33*b*, the block 46 urges against one of the stops and prevents further movement of the serpentine tensioner in a corresponding direction. However, as the serpentine tensioner 30 moves in an opposite direction, the stop (e.g., stop 33*a*) against which the block 46 had urged moves away from the block 46 and the opposed stop (e.g., stop 33*b*) moves toward the block until the serpentine tensioner 30 moves to maximum extent in the other direction and causes the other stop to urge against the block.

Figure 8:
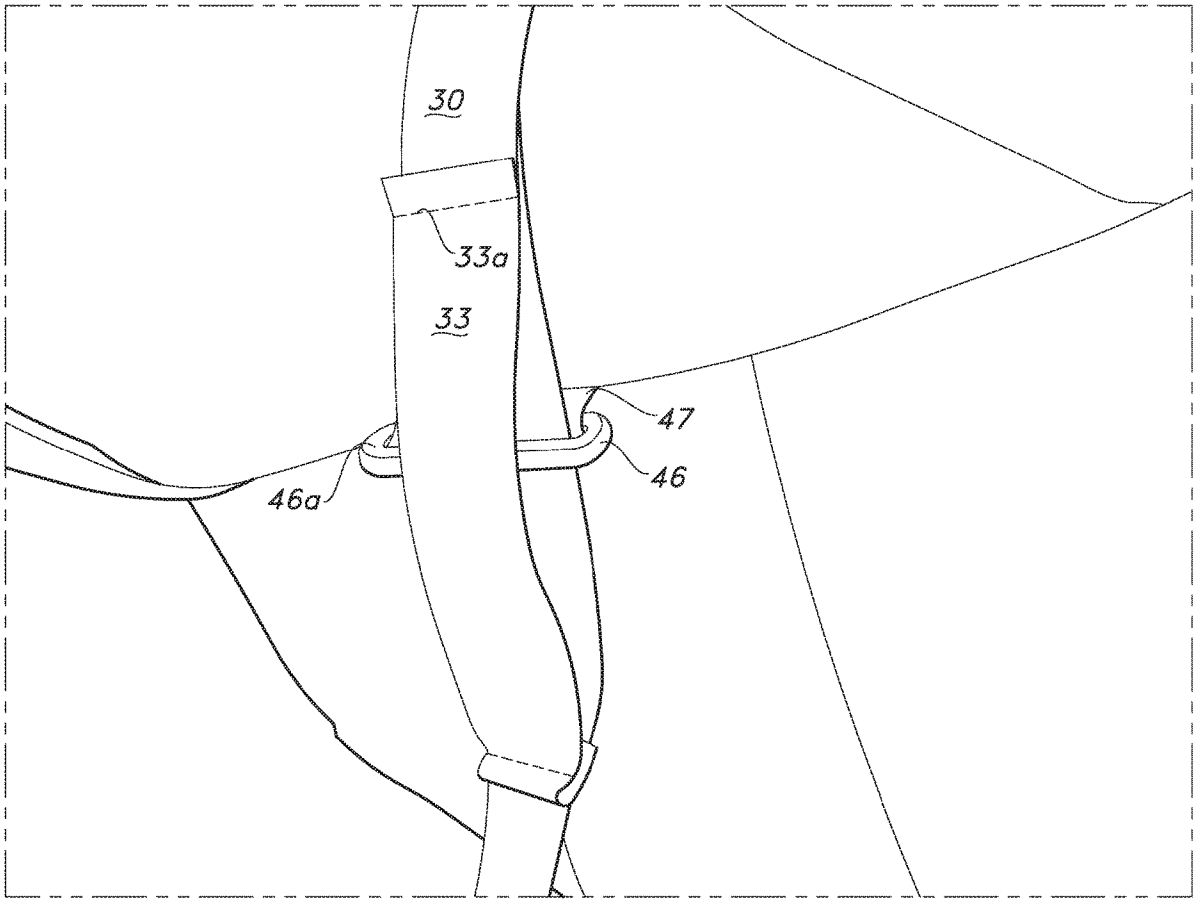
FIG. 8 shows an embodiment of a movement limiter.

FIG. 8 shows but one possible embodiment of such a movement limiter 33. The illustrated movement limiter 33 has a strap overlying the block 46 and being fixedly secured, e.g., stitched, at opposed ends to the serpentine tensioner. The regions of attachment between the overlying strap and the serpentine tensioner define the opposed stops 33*a*, 33*b* against which the block can urge at the maximum extents of movement of the serpentine tensioner relative to the depicted block. Other stop configurations are possible, including raised structures along the lines of rivets, grommets, posts, wedges, hooks, clasps, etc.

Anchors

As used herein, the term "anchor" refers to structure that couples or otherwise engages a load-bearing member (e.g., a shoulder strap, a hip pad, etc.) with a load carrier or a portion thereof. Disclosed anchors can, but need not, incorporate a block.

For example, referring to FIG. 1, each first terminal anchor 35 has a strap 36 overlying a portion of the corresponding serpentine tensioner 30 and being secured to the corresponding shoulder strap 20 with stitching on opposed sides of the respective serpentine tensioner. Stitching also secures the transverse strap 36 and the serpentine tensioner 30 to the shoulder strap 20 in the region of the strap overlying the serpentine tensioner. As another example, each serpentine tensioner 30 can be fixedly coupled with the respective hip pad 25 adjacent each respective second terminal coupler 40.

As yet another example, the intermediate anchor 45 depicted in FIGS. 1 through 4 and 8 immovably secures a block 46 to a region of the pack 10*a*. For example, a plastic plate can define adjacent slots 46*a* extending through the plate. The serpentine tensioner 30 can extend through one of the slots. A strap of nylon webbing or other material can extend through the other slot 46*a* and double back on itself so opposed ends of the strap are positioned adjacent to each other. The opposed ends (not shown) of the nylon strap can be stitched together in the seam formed between adjacent panels of the load carrier 15 forming the major compartment of the wearable pack 10*a*. Other arrangements for affixing the anchor to the load carrier are possible and include but are not limited to adhesives, rivets, snap-fit fasteners, hook-and-loop fasteners, welds, epoxies, zippers, and can include constructs formed of materials including fabric, metal, wood, composites, and/or plastics.

In some examples, the serpentine tensioner 30 is spaced apart from one or both terminal anchors 35, 40 and the corresponding load-bearing member 20, 25 couples the serpentine tensioner to the respective terminal anchor. In other examples, the serpentine tensioner can extend beyond the load-bearing member 20, 25 and couple the load-bearing member to the respective terminal anchor. In still other examples, the serpentine tensioner 30 and the load-bearing member 20, 25 are coextensive with each other.

In addition to the immovable anchors described above, some anchors 60 (FIG. 9) provide a movable engagement between a load-bearing member 20, 25 and the load carrier (or portion thereof). Such a movable engagement can include a slidable engagement, a roller engagement, or a combination thereof. Examples of movable engagements are described more fully below.

Movable Engagement Systems

As noted above, an anchor 60 can movably couple a load-bearing member 20, 25 to a load carrier. As but one possible example, a shuttle 61 affixed to a load-bearing member, e.g., a shoulder strap 20 or hip pad 25, can slidingly engage a track 65 affixed to the seam formed between adjacent panels of the load carrier 15 forming the major compartment of the wearable pack 10*b*, as shown in FIG. 9. In other embodiments, the shuttle 61 can be affixed to a serpentine tensioner 30, and the serpentine tensioner can be affixed to the load-bearing member 20, 25. The sliding engagement between the shuttle 61 and the track 65 and the fixed engagement between the shuttle 61 and the shoulder strap 20 (or hip pad 25) permits the shoulder strap (or hip pad) to be continuously repositioned relative to the load carrier 15 along the track 65.

In the depicted embodiment, the shuttle 61 defines opposed, curved jaws 62*a*, 62*b* that partially extend around a correspondingly configured track 65 having a circular or a substantially circular cross-section. The depicted track 65 has an internal bead (not shown) that carries the load applied to the track 65 by the opposed jaws 62*a*, 62*b*, and a fabric cover can extend around the internal bead. Opposed edges (not shown) of the cover can be stitched together in the seam formed between adjacent panels of the load carrier 15. Other track configurations are possible. For example, a track can define a C-shaped channel (not shown) and the shuttle can define a complementarily shaped member contained within the channel.

As another example, a discrete segment of track can be provided for each movable anchor 60. The segments of track can be spaced apart from each other and stops can be provided at each terminal end of the segments of track. In another embodiment, as shown in FIG. 9, the track 65 can continuously extend around an outer perimeter of the load carrier. Even with a continuous track, however, opposed stops can be provided at outermost extents of desirable movement of one or more movable anchors 60, defining a segment of track within a continuous track 65 enclosing a perimeter of the load carrier.

Both shuttle and track configurations can be arranged to permit the shuttle to slide or roll (or both) along the track and to restrain or otherwise inhibit movement of the shuttle in a direction transverse to the track. With such a track 65 and shuttle 61 anchor, the straps 20 and/or hip pads 25 can move continuously relative to the load carrier 15 (e.g., to accommodate users or supports of different sizes and shapes) while suspending the load carrier from a wearer's body or other structural support 11.

Although movable engagement between a shoulder strap 20 and the load carrier 15 are described above for succinctness, a similar sliding engagement can be provided between the hip pads 25 and the load carrier 15, as shown for example in FIGS. 9 through 13. For example, either or both of the first terminal anchor 35 and the second terminal anchor 40 shown in FIG. 1 can be movably coupled with the load carrier 15 as described above and fixedly attached to a corresponding load-bearing member 20, 25. Similarly, the intermediate anchor 45 shown in FIG. 1 can be movably coupled with the load carrier 15 using an approach as described herein to permit yet another degree of adjustment of the serpentine tensioner 30 relative to the load carrier 15.

Other Embodiments

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of fluid heat exchange systems that can be devised using the various concepts described herein. Moreover, those of ordinary skill in the art will appreciate that the exemplary embodiments disclosed herein can be adapted to various configurations without departing from the disclosed principles. For example, as noted above, some load-bearing systems include a serpentine tensioner 30 in combination with movable anchors 60 to facilitate a high-degree of customizable fit over a wide range of wearer body and/or other structural support 11 sizes.

For example, a load carrier 15 can have an upper region 16, a lower region 17, an intermediate region 18 positioned between the upper region and the lower region, and laterally opposed lateral regions 19*a*, 19*b* spanning the upper region, the intermediate region, and the lower region. A pair of laterally opposed shoulder straps 20 can be spaced apart from each other, and each shoulder strap's first terminal end 21 can be positioned adjacent the upper region 16 of a corresponding one of the opposed lateral regions 19*a*, 19*b* of the load carrier 15. A first terminal anchor 60 can correspond to each of the first terminal ends 21 of the shoulder straps. Each first terminal anchor 60 can be movably coupled with the corresponding region of the load carrier 15 such that each first terminal end 21 is continuously movable relative to the load carrier.

A first pair of detachably coupleable floating blocks 50*a*, 50*b* can be positioned adjacent the intermediate region 18 of the load carrier 15 and laterally inward of the opposed shoulder straps 20.

A pair of laterally opposed hip pads 25 can be spaced apart from each other, and each can have a respective first terminal end 26 coupled to the lower region 17 of the load carrier 15 and a respective second terminal end 27 positioned opposite the corresponding first terminal end. An intermediate anchor 45 can correspond to each of the first terminal ends 26 of the hip pads 25 and can be coupled with the intermediate region 18 of the load carrier 15 at a position laterally outward of the first pair of floating blocks 50*a*, 50*b*.

A second pair of detachably coupleable floating blocks 55*a*, 55*b* can be positioned adjacent the lower region 17 of the load carrier 15 and laterally inward of the intermediate anchors 45 and the opposed hip pads 25. A second terminal anchor 40 can correspond to each of the first terminal ends 26 of the hip pads 25 and can be coupled with the lower region 17 of the load carrier 15 at respective positions laterally outward of the second pair of detachably coupleable floating blocks 55*a*, 55*b* and opposite the upper region 16 of the load carrier relative to the respective intermediate anchor 45.

Each in a pair of opposed serpentine tensioners 30 can be fixedly coupled with a respective one of the first terminal anchors 35 and the corresponding second terminal anchor 40. The serpentine tensioners 30 can be slidably coupled with each respective one of the corresponding first floating block 50*a*, 50*b*, second floating block 55*a*, 55*b*, and intermediate anchor 45. Each respective serpentine tensioner 30 can extend from the corresponding first terminal anchor 35 to the corresponding first floating block 50*a*, 50*b*, from the corresponding first floating block to the corresponding intermediate anchor 45, from the corresponding intermediate anchor to the corresponding second floating block 55*a*, 55*b*, and from the corresponding second floating block to the corresponding second terminal anchor 40.

As well, a plurality of segments of track 65 can be affixed to the load carrier 15. Each first terminal anchor 35 can be configured as a movable anchor 60 and have a corresponding shuttle 61 so movably coupled with a corresponding segment of the track 65 as to permit the shuttle to move along the respective segment of track and to resist movement in a direction perpendicular to the segment of track. In some instances, the plurality of segments of track 65 are continuous with each other. Each serpentine tensioner 30 can have one or more movement limiters 33, wherein each respective movement limiter is configured to limit an extent of slidable movement of the serpentine tensioner 30 relative to a corresponding one of the intermediate anchor 45, the first slidable block 50*a*, 50*b*, and the second slidable block 55*a*, 55*b*. As well, in some embodiments, the intermediate anchors, the second terminal anchors, or both, can be movably coupled with the load carrier, as with a movable anchor 60.

Although the embodiments disclosed above have six generally symmetrically arranged points-of-attachment to the load carrier (three for each serpentine tensioner 30), other embodiments have a greater number of symmetrically arranged points-of-attachment between the serpentine tensioner and the load carrier. For example, some embodiments have eight symmetrically arranged points-of-attachment to the pack (four for each serpentine tensioner).

Disclosed principles pertaining to load-bearing systems are described in relation to embodiments of wearable packs for convenience. The term "wearable pack," as used herein, refers broadly to mountable packs configured to be mounted to (or worn by) a user, including packs with one or more load-bearing members, e.g., shoulder straps, hip pads, etc., along the lines of backpacks, rucksacks, daypacks, messenger bags, totes and other packs. The term "Backpack," unless context indicates otherwise, means a pack with a pair of shoulder straps. Nonetheless, disclosed principles can be applied to a variety of other mountable packs, including, without limitation, a backpack, daypack, rucksack, knapsack, pannier, courier bag, brief case, motorcycle tank bag, etc.

Disclosed wearable packs typically have at least one load carrier along the lines of a sack, a pouch, or a compartment, whether having no frame or an internal frame. Disclosed load carriers for a wearable pack or a different application can take the form of an external frame to which a sack, a pouch, a compartment, a bag, or any of a variety of other apparatus such as, for example, an axe, a pick, a shovel, a sleeping bag, a bow, a quiver, a fluid container, a bundle of rope, a helmet, a water bottle, a tent, a stove, etc., can attach. Disclosed load carriers typically are structurally coupled with one or more corresponding load-bearing members along the lines described above.

As used herein, the term "load-bearing member" refers broadly to a structural member along the lines of a strap, a tether, a strut, a post, or a pad configured to transfer all or a portion of a load carried by the respective load carrier to a wearer or other structural support. Some particular embodiments of load-bearing members can operate in tension or in compression, or both.

Directions and references (e.g., up, down, top, bottom, left, right, rearward, forward, etc.) may be used to facilitate discussion of the drawings but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by references in its entirety for all purposes.

The previous description of the disclosed embodiments is provided to enable any persons of ordinary skill in the art to make or use the disclosed innovations. Various modifications to those embodiments will be readily apparent to those skilled in the art, and the generic principles defined herein may be applied to other embodiments without departing from the spirit or scope of this disclosure. Thus, the disclosed inventions are not intended to be limited to the embodiments shown herein, but are to be accorded the full scope consistent with the language of this disclosure, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No element is to be construed under the provisions of 35 USC 112, sixth paragraph, unless the element is expressly recited using the phrase "means for" or "step for".

Thus, in view of the many possible embodiments to which the disclosed principles can be applied, it should be recognized that the above-described embodiments are only examples and should not be taken as limiting in scope. I therefore reserve all rights to the subject matter disclosed herein, including the right to claim any and all combinations of subject matter described herein, including but not limited to all that comes within the scope and spirit of the following paragraphs, notwithstanding that claims are an unnecessary component of a provisional patent application.

I currently claim:

1. A load-bearing system for a wearable pack, the system comprising:

a first floating block and a second floating block;

a first terminal anchor, a second terminal anchor, and an intermediate anchor, wherein each anchor is positioned laterally outward relative to the first floating block and the second floating block; and a serpentine tensioner fixedly coupled with the first terminal anchor and the second terminal anchor, and movably coupled with the first floating block, the second floating block, and the intermediate anchor.

2. The load-bearing system according to claim 1, wherein the serpentine tensioner extends from the first terminal anchor to the first floating block, from the first floating block to the intermediate anchor, from the intermediate anchor to the second floating block, and from the first floating block to the second terminal anchor.

3. The load-bearing system according to claim 1, further comprising a load-bearing member, wherein at least a portion of the serpentine tensioner is coextensive with a corresponding portion of the first load-bearing member.

4. The load-bearing system according to claim 3, wherein the load-bearing member comprises a first shoulder strap, the load-bearing system further comprising a second shoulder strap positioned laterally opposite the first shoulder strap relative to the first floating block.

5. The load-bearing system according to claim 3, wherein the load-bearing member comprises a first hip pad, the load-bearing system further comprising a second hip pad positioned laterally opposite the first hip pad relative to the second floating block.

6. The load-bearing system according to claim 1, further comprising a load carrier, wherein one or more of the first terminal anchor, the intermediate anchor and the second terminal anchor is movably coupled with the load carrier.

7. The load-bearing system according to claim 6, further comprising a load-bearing member fixedly coupled with a movable one or more of the first terminal anchor, the intermediate anchor and the second terminal anchor.

8. The load-bearing system according to claim 1, further comprising a respective movement limiter corresponding to one or more of the intermediate anchor, the first slidable block, and the second slidable block, wherein each respective movement limiter is configured to limit an extent of slidable movement of the serpentine tensioner relative to the respective one or more of the intermediate anchor, the first slidable block, and the second slidable block.

9. A load-bearing system for a load-carrying apparatus, the system comprising:

a load carrier having a vertical axis generally aligned with a direction of gravity when the load-carrying apparatus is in use and a lateral axis extending generally transversely relative to the vertical axis;

a load-bearing member extending from a corresponding first end to an opposed second end;

a first floating block and a second floating block;

a first terminal anchor fixedly attached to the first end of the load-bearing member and so coupled with the load carrier as to resist movement of the first end of the load-bearing member relative to the load carrier in a direction parallel to the vertical axis;

an intermediate anchor configured to couple the second end of the load-bearing member to the load carrier;

a second terminal anchor coupled with the load carrier, wherein each anchor is positioned laterally outward relative to the first floating block and the second floating block; and a serpentine tensioner fixedly coupled with the first terminal anchor and the second terminal anchor, and movably coupled with the first floating block, the second floating block, and the intermediate anchor.

10. The load-bearing system according to claim 9, wherein the load-bearing member comprises a first load-bearing member, the load-bearing system further comprising a second load-bearing member fixedly coupled with the second terminal anchor.

11. The load-bearing system according to claim 10, wherein the first load-bearing member comprises a shoulder strap and the second load-bearing member comprises a hip pad.

12. The load-bearing system according to claim 9, wherein the serpentine tensioner is affixed to the first terminal anchor.

13. The load-bearing system according to claim 9, wherein the serpentine tensioner is spaced apart from the first terminal anchor and the corresponding load-bearing member couples the serpentine tensioner to the first terminal anchor.

14. The load-bearing system according to claim 9, wherein the first terminal anchor comprises one or more of a reinforced region of fabric, a mesh, a metal, a wood, a composite, and a plastic.

15. The load-bearing system according to claim 9, wherein the first terminal anchor movably couples the load-bearing member with the load carrier.

16. The load-bearing system according to claim 15, wherein the first terminal anchor comprises a shuttle movably coupled to a track.

17. The load-bearing system according to claim 16, wherein the track is affixed to the load carrier and the shuttle is affixed to the load-bearing member.

18. The load-bearing system according to claim 16, wherein the load-bearing member, the shuttle, and the track are so complementarily configured that the load-bearing member is movable along the track in correspondence with the shuttle to in a manner suitable to reposition the load-bearing member relative to the load carrier to accommodate a plurality of user sizes and to transfer a load from the load carrier to the load-bearing member for each of the plurality of user sizes.

19. The load-bearing system according to claim 16, wherein the serpentine tensioner is affixed to the shuttle.

20. A load-bearing system for a load-carrying apparatus, the system comprising:

a load carrier having an upper region, a lower region, an intermediate region positioned between the upper region and the lower region, and laterally opposed lateral regions spanning the upper region, the intermediate region, and the lower region;

a pair of laterally opposed shoulder straps spaced apart from each other, wherein each shoulder strap has a first terminal end and an opposed second terminal end, wherein each first terminal end is positioned adjacent the upper region of a corresponding one of the opposed lateral regions of the load carrier;

a first terminal anchor corresponding to each of the first terminal ends of the shoulder straps, wherein each first terminal anchor is movably coupled with the corresponding region of the load carrier such that each first terminal end is continuously movable relative to the load carrier;

a first pair of detachably coupleable floating blocks positioned adjacent the intermediate region of the load carrier and laterally inward of the opposed shoulder straps;

a pair of laterally opposed hip pads spaced apart from each other, each having a respective first terminal end coupled to the lower region of the load carrier and respective second terminal end positioned opposite the corresponding first terminal end;

an intermediate anchor corresponding to each of the first terminal ends of the hip pads and coupled with the intermediate region of the load carrier at a position laterally outward of the first pair of floating blocks;

a second pair of detachably coupleable floating blocks positioned adjacent the lower region of the load carrier and laterally inward of the intermediate anchors and the opposed hip pads;

a second terminal anchor corresponding to each of the first terminal ends of the hip pads and coupled with the lower region of the load carrier at a position laterally outward of the second pair of detachably coupleable floating blocks and opposite the upper region of the load carrier relative to the respective intermediate anchor; and a pair of opposed serpentine tensioners, each being fixedly coupled with a respective one of the first terminal anchors and the corresponding second terminal anchor, and slidably coupled with each respective one of the corresponding first floating block, second floating block, and intermediate anchor, wherein each respective serpentine tensioner extends from the corresponding first terminal anchor to the corresponding first floating block, from the corresponding first floating block to the corresponding intermediate anchor, from the corresponding intermediate anchor to the corresponding second floating block, and from the corresponding second floating block to the corresponding second terminal anchor.

* * * * *